US005955412A

United States Patent [19]

Post et al.

[11] Patent Number: 5,955,412

[45] Date of Patent: Sep. 21, 1999

[54] POWDERED COIL CLEANER

[76] Inventors: Sarah E. Post; Donald J. Ashby, both of 1312 Hearda Cove, Gulfport, Miss. 39503; Benny Surratt, 2230 Baywood Dr., Biloxi, Miss. 39532

[21] Appl. No.: 08/976,292

[22] Filed: Nov. 21, 1997

Related U.S. Application Data

[60] Provisional application No. 60/031,685, Nov. 22, 1996.

[51] Int. Cl.[6] ..... C11D 3/08; C11D 11/00; C11D 17/06

[52] U.S. Cl. ..... 510/247; 510/109; 510/254; 510/438; 510/490; 510/501; 510/511

[58] Field of Search ..... 510/247, 109, 510/254, 438, 490, 501, 511

[56] References Cited

FOREIGN PATENT DOCUMENTS

| | | |
|---|---|---|
| 2121565 | 11/1972 | Germany . |
| 1291370 | 10/1972 | United Kingdom . |
| 9218594 | 10/1992 | WIPO . |
| 9533029 | 12/1995 | WIPO . |

*Primary Examiner*—Lorna Douyon
*Attorney, Agent, or Firm*—Garvey, Smith, Nehrbass & Doody, LLC

[57] ABSTRACT

A powder blend of 95% Sodium metasilicate anhydrous and 5% sodium lauroyl sarcosinate which is hygroscopic. The mixture is formulated for effective use when 11.25 ounces are dissolved in one gallon of water or diluted up to six gallons of water. The constituent powders are added to the drum at their mixture ratio of 95% sodium metasilicate and 5% sodium lauroyl sarcosinate which will form the blend. The drum is resealed with the processing lid trapping only low moisture air inside. The drum is relocated to the blending machine which rolls and tilts the drum for blending for 30 minutes at 16 rpm, which ensures complete and uniform blending of the 2 constituent powders. Next, the drum is removed from the blending machine, and the processing drum lid is removed in the process room ensuring low moisture exposure. A filling lid is installed which includes an auger feed, and the drum is rotated and placed in the filling stand. An air motor is attached to the auger. The blended powder is dispensed from the drum at a uniform speed into packaging containers. These containers are dispensed from the drum at a uniform speed into packaging containers. Screw lids with pressure sensitive moisture barrier liners are used to seal the bottles. Once the bottles are sealed, they are removed from the process room and packaged in cardboard case lots.

6 Claims, No Drawings

POWDERED COIL CLEANER

CROSS-REFERENCE TO RELATED APPLICATIONS

Priority of U.S. provisional patent application Ser. No. 60/031,685, filed Nov. 22, 1996, is hereby claimed. That application is hereby incorporated by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to coil cleaners. More particularly, the present invention relates to a powdered coil cleaner which may serve as a replacement for the traditional liquid and concentrate coil cleaners and as part of the formulation, including a corrosion inhibitor for protecting nickel surfaces found in coils and for inhibiting future corrosion.

2. General Background of the Invention

In the art of cleaners, particularly coil cleaners, it is quite well known that such cleaners are traditionally formulated and marketed in the liquid or in concentrate form. However, in such states it is known that the cleaners can exhibit hazardous characteristics to health and the environment. Therefore, there is a need for a non-liquid formulation which reduces these risks yet is as or more effective in cleaning, and having other positive characteristics, than the current state of the art liquid coil cleaners.

BRIEF SUMMARY OF THE INVENTION

The composition of the present invention would comprise a formulation of fine granular particles which exist in the physical state as a solid until exposed to and dissolved in water forming a cleaning solution. In summary, when the composition is dissolved in water, the resulting cleaning solution exhibits similar cleaning characteristics of traditional liquid coil cleaners, which is primarily to break down grease, loosen dirt, dissolve corrosion and scale, and brighten metal. There is further included a means by which the composition leaves a protective coating on many of the cleaned metals which inhibit future corrosion.

Therefore, it is a principal object of the present invention to provide a cleaner which reduces the hazardous characteristics to help an environment while providing a simple powerful cleaning tool for the air conditioning trade similar in performance to existing hazardous liquid cleaners;

It is a further principal object of the present invention to provide substantial benefits over the existing art as follows:

a) reducing the environmental risk of said cleaner;

b) likewise reducing health risks of cleaners;

c) comprises a mixture of fine granular solids d) providing a mixture of fine granular solids for transport and storage;

e) having characteristics of providing a limited flowability of the powder over that of comparable liquids which minimizes spillage and environmental risks;

f) provides hygroscopic affinity when exposed to air and moisture to form clumps or crusts which deters flow and aids in containment;

g) the composition does not readily change state to a liquid when exposed to the environment;

h) the physical state of a solid provides a more favorable health rating due to lower skin irritation level because of slower absorption rate and smaller surface area in contact with the skin;

i) the cleaner removes grease, dirt, corrosion, scales;

j) the composition leaves a protective coating on many metal surfaces which inhibits future corrosion;

k) the cleaner cleans coils used in heating ventilation, air-conditioning refrigeration cooling applications including but not limited to evaporators and condensers, heat exchanges, etc.

l) the composition is mixed with water at the time of application into a liquid form for use.

DETAILED DESCRIPTION OF THE INVENTION

The preferred embodiment of the formulation of the present invention provides a powder mixture which is comprised of 95% Sodium metasilicate anhydrous and 5% sodium lauroyl sarcosinate. The mixture is hygroscopic. The solubility rate of the 11.25 ounces of the mixture in one gallon of water at 19° C. using agitation is 90 seconds. The 11.25 ounces of mixture exhibits a pH of 13 when dissolved in one gallon of water and a pH of 12.5 when dissolved in six gallons of water. The mixture is formulated for effective use when 11.25 ounces are dissolved in one gallon of water or diluted up to six gallons of water.

Prior to a discussion of the process through which the constituents of the formulation of the present invention is undertaken, the particular characteristics of each constituent will be discussed individually.

There are many forms of sodium silicate. The selection of a beaded anhydrous sodium metasilicate form was chosen for its aspects of safe cleaning as a dustless, quick dissolving concentrated source of alkali and silica. Sodium metasilicate has a definite crystalline form and a 1:1 molar ratio of $SiO_2$ to $Na_2O$. The product is free flowing and has uniform particle size when aids in the mixing and packaging process.

This form of sodium silicate has a rapid and uniform dissolution rate in water. Specifically, a 5% by weight of product will dissolve in 80 seconds in 70° F. water while stirring. The dissolution rate is extremely important since the goal and uniqueness of this product is to provide a new powder replacement for the existing liquid products. Ease and speed of dissolving product in water will help eliminate human perceived barriers of inconvenience.

Sodium metasilicate is highly alkaline. Alkalinity is extremely important in the cleaning power and effectiveness. This alkalinity enables it to neutralize acid soil, to aid in saponification and emulsification of fats and oils, and to enhance solubility or dispersion of paints and proteinaceous materials.

The strong buffering capacity of sodium metasilicate maintains the pH at a high level even in the presence of acidic soils and dilution. Most alkalies will exhibit a sharp drop in pH as acidic soil loading occurs. This declining pH reduces the overall effectiveness and performance of the cleaning solution by lowering the levels of the surfactant systems performance. Sodium metasilicate maintains almost a constant pH even with extreme loading.

The cleaning power of Sodium metasilicate is its ability to remove and suspend oily soils in the application water where it separates and prevents the recombining of particles until rinsing. The negative charge on sodium metasilicate particles repels the typical negative charge of particulate soils which prevents particles from reattaching, recombining and settling out of solution. Suspended particles are the easiest to remove. Sodium metasilicate will also break up agglomerated masses of particulate soils into very fine particles which are suspended in the application solution and easily removed with rinsing.

The selection of sodium metasilicate provides an additional aspect of inhibiting corrosion of the metal. It is the silica monomer in the sodium metasilicate which inhibits the corrosion. The silica monomer is reactive with cationic metals and metal surfaces. The monomeric silica is absorbed onto the metal surface where an anodic reaction occurs between the metal and silica. This reaction causes a protective film to be laid down on the metal surface which retards the electrochemical reactions of corrosion. The film also acts as an electrical insulator. This film is formed by sodium metasilicate on many types of metals but primarily particular to our application is that of copper.

Sodium lauroyl sarcosinate is a mild water soluble anionic surfactant which imparts excellent foaming and wetting characteristics, good detergency, and is rapidly biodegradable. It remains soluble in highly alkaline solutions and has good tolerance to hard water.

Because sodium metasilicate is hygroscopic, the exposure of sodium metasilicate to water and moisture must be minimized. Therefore, the processing environment must have a low humidity level.

In formulating the composition of the present invention, there must be attention paid to the circumstances under which the formulation takes place. The processing room should be temperature and humidity controlled to remain cool with a maximum of 50% RH. The batch process required number of bags of sodium metasilicate are placed in the processing environment, or room. The bags have been sealed against moisture and air. The open process drum used for blending and filling is located in the process environment. The drum includes mixing fins to increase blending and a fiberglass interior coating for chemical inertness.

Following this initial process in preparing the processing room, the room is brought to required temperature and relative humidity. The sodium metasilicate bags and sodium lauroyl sarcosinate bags are opened, and the constituent powders are added to the drum at their mixture ratio of 95% sodium metasilicate and 5% sodium lauroyl sarcosinate which will form the blend. The drum is resealed with the processing lid trapping only low moisture air inside. The drum is relocated to the blending machine which rolls and tilts the drum for blending. In the preferred embodiment of the process, the drum processes for 30 minutes at 16 rpm, which ensures complete and uniform blending of the 2 constituent powders, or until the constituents define a blended powder which is cohesive and non-flowing. Next, the drum is removed from the blending machine, and the processing drum lid is removed in the process room ensuring low moisture exposure. A filling lid is installed which includes an auger feed, and the drum is rotated and placed in the filling stand. An air motor is attached to the auger. The blended powder is dispensed from the drum at a uniform speed into packaging containers. These containers are dispensed from the drum at a uniform speed into packaging containers. These containers are made of high density polyethylene and are round plastic jars of the wide mouth variety which are about 2" diameter and 5" tall. Each container is filled with 11.25 ounces of blended powder product. Screw lids with pressure sensitive moisture barrier liners are used to seal the bottles. Once the bottles are sealed, they are removed from the process room and packaged in cardboard case lots.

The foregoing embodiments are presented by way of example only; the scope of the present invention is to be limited only by the following claims.

We claim:

1. A process for formulating a powder coil cleaner, comprising the following steps:

a. providing powdered constituents consisting of 95% by weight of sodium metasilicate and 5% by weight of sodium lauroyl sarcosinate in a low humidity environment;

b. combining the powdered constituents together in a blending drum in the low humidity environment;

c. sealing the drum so that the moisture within the drum containing the powdered constituents is at a relative humidity no greater than 50%;

d. blending the powdered constituents within the drum for approximately 30 minutes at 16 rpms, or until the constituents define a blended powder which is cohesive;

e. dispensing the blended powder into containers within the low humidity environment; and f. sealing the containers containing the blended powder with moisture barrier sealing means for packaging.

2. The process in claim 1, wherein the blending drum is of the type having mixing fins to increase blending and a fiberglass interior for coating for chemical inertness.

3. The process in claim 1, wherein the blended powder has a solubility rate of 11.25 ounces of the blended powder in one gallon of water at 19° C., while agitating for 90 seconds.

4. A powdered coil cleaner having a high solubility rate when blended in water, consisting of blended powdered constituents of 95% by weight sodium metasilicate and 5% by weight sodium lauroyl sarcosinate, formulated by the process of:

a. combining the powdered constituents together in a blending drum in a low humidity environment;

b. sealing the drum so that the moisture within the drum containing the powdered constituents is at a relative humidity no greater than 50%;

c. blending the powdered constituents within the drum for approximately 30 minutes at 16 rpms, or until the constituents define a blended powder which is cohesive and non-flowing;

d. dispensing the blended powder into containers within the low humidity environment; and e. sealing the containers containing the blended powder with moisture barrier sealing means for packaging.

5. The powdered coil cleaner produced by the process in claim 4, wherein the blended powdered has a solubility rate of 11.25 ounces of the blended powdered in one gallon of water at 19° C., while agitating for 90 seconds.

6. A powdered coil cleaner blend, having fast-dissolving characteristics when blended with water, the blend consisting of;

a. 95% by weight sodium metasilicate; and, b. 5% by weight sodium lauroyl sarcosinate wherein 5% by weight of the blend dissolves within 80 seconds in 70° F. water while stirring.

* * * * *